US011174679B2

(12) United States Patent
Bruandet

(10) Patent No.: US 11,174,679 B2
(45) Date of Patent: Nov. 16, 2021

(54) DOWN THE HOLE DRILLING MACHINE AND METHOD FOR DRILLING ROCK

(71) Applicant: SANDVIK INTELLECTUAL PROPERTY AB, Sandviken (SE)

(72) Inventor: Olivier Bruandet, Tampere (FI)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 57 days.

(21) Appl. No.: 16/617,824

(22) PCT Filed: May 31, 2018

(86) PCT No.: PCT/EP2018/064317
§ 371 (c)(1),
(2) Date: Nov. 27, 2019

(87) PCT Pub. No.: WO2018/220097
PCT Pub. Date: Dec. 6, 2018

(65) Prior Publication Data

US 2020/0190906 A1 Jun. 18, 2020

(30) Foreign Application Priority Data

Jun. 2, 2017 (EP) ..... 17174124

(51) Int. Cl.
*E21B 4/14* (2006.01)
*E21B 10/38* (2006.01)

(52) U.S. Cl.
CPC ..... *E21B 4/14* (2013.01); *E21B 10/38* (2013.01)

(58) Field of Classification Search
CPC ..... E21B 4/14; E21B 10/38
See application file for complete search history.

(56) References Cited

U.S. PATENT DOCUMENTS

| | | | | |
|---|---|---|---|---|
| 3,599,730 A * | 8/1971 | Luthman | E21B 4/14 173/17 |
| 4,583,601 A | 4/1986 | Techy | |
| 4,821,812 A * | 4/1989 | Ditzig | E21B 4/14 173/137 |
| 5,131,476 A | 7/1992 | Harrington | |
| 5,562,170 A | 10/1996 | Wolfer | |
| 5,711,205 A * | 1/1998 | Wolfer | E21B 4/003 91/218 |
| 7,921,941 B2 * | 4/2011 | Aros | E21B 4/14 175/296 |

(Continued)

FOREIGN PATENT DOCUMENTS

| | | |
|---|---|---|
| CL | 199501151 | 8/1995 |
| CL | 201301863 | 6/2003 |

(Continued)

*Primary Examiner* — Jennifer H Gay
(74) *Attorney, Agent, or Firm* — Corinne R. Gorski

(57) ABSTRACT

A down the hole rock drilling machine and a method of drilling rock. The drilling machine comprises a casing (15) inside which is a control sleeve (20). A reciprocating piston (19) is arranged to move inside the control sleeve and control feeding and discharging of working chambers (20, 21). Between the control sleeve and an inner surface of the casing are all the fluid passages (28, 29, 30, 31) needed for fluid routing. The piston opens and closes transverse openings and controls the work cycle.

12 Claims, 7 Drawing Sheets

(56) References Cited

U.S. PATENT DOCUMENTS

| | | | | |
|---|---|---|---|---|
| 8,640,794 | B2 * | 2/2014 | Aros | E21B 10/38 175/296 |
| 8,973,681 | B2 * | 3/2015 | Aros | E21B 4/14 175/296 |
| 9,016,403 | B2 * | 4/2015 | Aros | E21B 4/14 175/296 |
| 10,316,586 | B1 * | 6/2019 | Aros | E21B 4/14 |
| 2009/0188723 | A1 * | 7/2009 | Aros | E21B 4/14 175/296 |
| 2011/0209919 | A1 * | 9/2011 | Aros | E21B 10/38 175/296 |
| 2013/0233626 | A1 * | 9/2013 | Aros | E21B 4/14 175/296 |
| 2014/0076638 | A1 * | 3/2014 | Aros | E21B 49/005 175/296 |
| 2017/0088932 | A1 | 3/2017 | Plana et al. | |
| 2020/0190906 | A1 * | 6/2020 | Bruandet | E21B 10/38 |
| 2020/0347689 | A1 * | 11/2020 | Moyes | E21B 4/14 |
| 2020/0370373 | A1 * | 11/2020 | Aros | E21B 10/38 |

FOREIGN PATENT DOCUMENTS

| | | | | |
|---|---|---|---|---|
| CL | 200900057 | | 1/2009 | |
| CL | 201701018 | | 4/2017 | |
| EP | 334559 | A2 | 1/1995 | |
| JP | H04169693 | A | 6/1992 | |
| RU | 1797650 | A3 | 2/1993 | |
| RU | 2549649 | C1 | 4/2015 | |
| RU | 2580112 | C1 | 4/2016 | |
| SU | 1293328 | A1 | 2/1987 | |
| WO | WO-2012116460 | A1 * | 9/2012 | E21B 4/14 |
| WO | WO2018107304 | | 6/2018 | |

* cited by examiner

DOWN THE HOLE DRILLING MACHINE AND METHOD FOR DRILLING ROCK

RELATED APPLICATION DATA

This application is a § 371 National Stage Application of PCT International Application No. PCT/EP2018/064317 filed May 31, 2018 claiming priority to EP 17174124.2 filed Jun. 2, 2017.

BACKGROUND OF THE INVENTION

The invention relates to a down the hole drilling machine comprising an impact device and especially to fluid conveyance and routing inside the impact device. The drilling machine is provided with a reciprocating percussion piston, which is moved by controlling feeding and discharging pressurized fluid into an out of working chambers where working surfaces of the piston are located. The piston is configured to strike to a drill bit being connected directly to the drilling machine.

Further, the invention relates to a method for drilling rock.

The field of the invention is described in more detail in the preambles of the independent claims of the application.

Holes can be drilled in rock by means of various rock drilling machines. Drilling may be performed with a method combining percussions and rotation. Then the drilling is called percussive drilling. Further, the percussive drilling may be classified according to whether an impact device is outside the drill hole or in the drill hole during the drilling. When the impact device is in the drill hole, the drilling is typically called down-the-hole drilling (DTH). Since the impact device is in the DTH drilling machine located inside the drill hole, structure of the impact device needs to be compact.

In the known DTH drilling machines efficiency of the impact devices are shown not to be satisfactory.

BRIEF DESCRIPTION OF THE INVENTION

It is an object of this invention to provide a novel and improved drilling machine and a method for drilling rock.

The drilling machine according to the invention is characterized by characterizing features of independent apparatus claim.

The method according to the invention is characterized by characterizing features of independent method claim.

An idea of the disclosed solution is that the down the hole drilling machine comprises an elongated casing inside which is a control sleeve. A reciprocating fluid driven piston of an impact device of the drilling machine is arranged inside the control sleeve. In other words, the casing surrounds the control sleeve and the control sleeve surrounds the piston. At both end sides of the piston are working chambers i.e. a top working chamber and a bottom working chamber, into which pressurized fluid is fed and from which fluid is discharged according to work cycle of the piston. Feed flows to both working chambers and discharge flows from both working chambers are conveyed in fluid passages, which are arranged between an outer surface of the control sleeve and an inner surface of the casing. In other words, the feed and discharge feed flows are conveyed in flow paths, which are located between surfaces of the control sleeve and the casing. The fluid passages or flow paths are located outside the piston.

An advantage of the disclosed solution is that the structure may be relatively simple and number of components is low.

Therefore maintenance is easy and manufacturing costs may be low. No movable separate control elements are needed but instead the control element offers the fluid passages and openings and the piston controls the fluid flows through them.

An advantage of the disclosed fluid routing, which is arranged outside the piston, allows working areas of the piston inside the top and bottom working chambers to be dimensioned as great as possible. Increased size of the working areas affected by pressurized fluid means that greater impact pulses can be produced. Thereby effectivity of the impact device may be increased, and still, outer dimensions of the impact device do not increase significantly.

An idea of an embodiment is that the piston is supported and sealed in radial direction only against inner surfaces of the control sleeve. In other words, bearing surfaces and seals of the piston are located between the piston and the control sleeve. An advantage is that the bearing and sealing surfaces are easier to form to smaller separate pieces like the piston and the control sleeve than to the casing or other larger body part. Further, the piston and the control sleeve are separate components allowing them to be changed when being worn.

An idea of an embodiment is that an inner surface of the casing and an outer surface of the control sleeve are in physical contact with each other. In other words, the surfaces are against each other except at areas where the fluid passages are located.

An idea of an embodiment is that the top working chamber is located entirely inside a top end portion of the control sleeve.

An idea of an embodiment is that the control sleeve is an immobile control element. The control sleeve does not move axially or rotate during the work cycle. Thus, the control sleeve may be connected immovably to the casing. The piston moves relative to the control sleeve and causes fluid passages to open and close.

An idea of an embodiment is that axial position of the control sleeve is adjustable relative to the casing. An advantage of this solution is that timing of feed and discharge flows may be fine adjusted by adjusting axial position of the control sleeve. Thereby it is possible to provide the drilling machine with asymmetric fluid circulation, for example. The position adjustment may be executed by means of separate adjusting elements, such as adjusting screws.

An idea of an embodiment is that the casing is a single piece, whereby the structure may be robust and simple.

An idea of an embodiment is that the casing is a simple tube-like frame part without complicated drillings and machined shapes. The casing may be without any transverse through holes and an inner surface of the casing may be smooth.

An idea of an embodiment is that the control sleeve comprises on its outer surface several fluid passages or flow paths. The flow passages are predominantly axially directed and are in fluid connection with transverse through openings. The transverse openings allow fluid flow between the outer surface and the inner surface of the control sleeve. Since the control sleeve is relatively small in size, it is easy to provide it with the needed axial and transverse fluid paths.

An idea of an embodiment is that the control sleeve comprises several grooves on its outer surface. The grooves serve as axial fluid passages. In other words, the mentioned fluid passages are defined by the grooves and the inner surface of the casing. The grooves are easy to machine on the outer surface of the control sleeve by means of a milling machine, for example.

An idea of an embodiment is that the outer periphery of the control sleeve has several groove-like top feed passages for connecting the top working chamber to the fluid supply. The outer periphery may also comprise several groove-like bottom feed passages for connecting the bottom working chamber to the fluid supply, and further, several groove-like discharge passages for discharging the fluid from the working chambers. Thus, the control sleeve may comprise two or more similar fluid passages spaced around the outer periphery of the sleeve. The use of several similar fluid passages around the control sleeve ensure that they able together to convey the needed fluid flow.

An idea of an embodiment is that the fluid passages between the casing and the control sleeve are formed on the inner surface of the casing, and not to the control sleeve as in the previous embodiments. Thus, the inner surface of the casing may be provided with several grooves forming the axial portions of the fluid passages. The outer surface of the control sleeve may then be a smooth surface without any grooves. However, the control sleeve still comprises the trough holes connecting the inner and outer spaces. In this embodiment the axial portions of the fluid passages are defined by the grooves and the smooth outer surface of the control sleeve.

An idea of an embodiment is that the fluid passages between the casing and the control sleeve comprise axial portions which are formed of combined grooves of the control sleeve and the casing. Thus, the outer surface of the control sleeve and the inner surface of the casing may both comprise groove halves which are aligned so that they form together the needed fluid passages.

An idea of an embodiment is that the piston has a solid outer surface or shell. Thereby the piston is without any a transverse through openings. When the piston has no cross holes, the structure may be simple and robust. However, the piston may or may not comprise at least one axial opening extending longitudinally end to end of the piston. In a reverse circulation drilling the piston comprises a central opening through which a central collecting tube is arranged. In this solution the piston is a sleeve-like piece without transverse holes.

An idea of an embodiment is that the piston has a solid-core configuration without any axial or transverse openings. When the piston has no axial or central openings and is without cross holes or any through holes, the structure of the piston is robust and durable. Further, the solid-core piston is easy to manufacture.

An idea of an embodiment is that the piston has a flat top end. In other words, the top end is without recesses or shoulders.

An idea of an embodiment is that the top end of the piston has a recess serving as a part of volume of the top working chamber. However, the recess is blind i.e. it is without any separate fluid passage.

An idea of an embodiment is that the piston has a top end the area of which corresponds with the cross sectional area of the inner surface of the control sleeve. In other words, the inner diameter of the control sleeve defines maximum working area of the piston affecting in the impact direction.

An idea of an embodiment is that the top end of the piston comprises a total first working area facing the top working chamber, and the bottom end of the piston comprises a total second working area facing the bottom working chamber. The first and second working area are dimensioned to be equal in size. However, in an alternative solution, the working areas are different in size ensuring proper initiation of a working cycle of the piston after stoppage of the working cycle.

An idea of an embodiment is that the drill bit comprises a central recess having a first open end towards the piston and a second closed end facing away from the piston. The recess of the drill bit is configured to constitute an additional fluid space and to be part of the bottom working chamber. In other words, part of volume of the bottom working chamber is located inside the drill bit. When the bottom working chamber is partly inside the control sleeve and partly inside the drill bit, volume of the bottom working chamber may be increased without increasing outer dimensions of the drilling machine.

An idea of an embodiment is that the drill bit comprises a recess, which serves as an additional space for the bottom working chamber. The additional fluid space is configured to be discharged via an open first end of the recess to the sides of the drill bit, and further through separate flushing channels connecting the sides and a face surface of the drill bit. Thus, the discharged fluid may be directed to the face surface of the drill bit by means of the flushing channels of the drill bit.

An idea of an embodiment is that the drill bit comprises a recess, which serves as an additional space for the bottom working chamber. The additional fluid space may comprise one or more transverse discharge channels proximate to a closed end of the recess and extending to the side of the drill bit.

An idea of an embodiment is that the impact device comprises an annular central feed chamber. The feed chamber is located between the outer surface of the piston and the inner surface of the control sleeve. The central feed chamber is in constant fluid connection to the inlet port during the work cycle of the impact device. Thereby feed pressure prevails inside the central feed chamber and the piston is configured to control feeding of fluid from the feed chamber to the top working chamber and the bottom working chamber. The piston moving during the work cycle opens and closes transverse openings of the control sleeve.

An idea of an embodiment is that the impact device comprises an annular central feed chamber, which is defined by a central portion of the piston and by the inner surface of the control sleeve. The central portion of the piston is provided with a cavity having smaller diameter compared to diameters of the end portions of the piston. In other words, the piston has a central thinned portion provided with the smaller diameter and defining the annular feed chamber.

An idea of an embodiment is that the impact device comprises an annular central feed chamber between the outer surface of the piston and the inner surface of the control sleeve. Further, between the control sleeve and the inner surface of the casing is at least one axial top feed passage extending from the central feed chamber towards the top working chamber. Correspondingly, between the control sleeve and the inner surface of the casing is at least one axial bottom feed passage extending from the central feed chamber towards the bottom working chamber. The axial top and bottom feed chambers allow feed flows to be conveyed from the central feed chamber to the working chambers. Both working chambers are fed via the central feed chamber.

An idea of an embodiment is that the impact device comprises an annular central feed chamber between the outer surface of the piston and the inner surface of the control sleeve. Further, between the control sleeve and the inner surface of the casing is at least one main feed passage extending form the top side end of the control sleeve to the central feed chamber. The main feed passages may comprise grooves on the outer surface of the control sleeve. By means of the main feed passage feed flow may be conveyed from the inlet port to the central feed chamber, wherefrom the fluid may be further conveyed to the working chambers. By means of the main feed passage the central feed chamber is in constant feed fluid connection during the work cycle.

An idea of an embodiment is that the top working chamber and the bottom working chamber of the impact device are discharged through one or more shared axial discharging passages. Also the shared discharging passage is located between the control sleeve and the inner surface of the casing. The shared axial discharging passage has connection to at least one first transverse opening at the top working chamber and at least one second transverse opening at the bottom working chamber. When the piston moves, it is configured to open and close alternately discharge openings of the top and bottom working chambers. The shared axial discharging passage may extend to the drill bit, which may be provided with at least one discharging groove on an outer surface of the drill bit.

An alternative solution for the previous embodiment is that the top working chamber and the bottom working chamber have discharging passages of their own.

An idea of an embodiment is that the drilling machine utilizes a reverse circulation principle wherein drilling cuttings are conveyed from a face side of the drill bit through an inner tube, which is located inside a central opening of the piston. Thus, the piston is in this solution a sleeve-like piece without transverse through openings. The inner tube extends from the drill bit to the top end portion of the drilling machine. Both working chambers may be discharged through at least one transverse discharge passage to the side of the drill bit and further through at least one discharge channel to the face side of the drill bit. The drill bit comprises a central opening extending end to end of the drill bit. The inner tube is in fluid connection with the top end of the central opening of the drill bit allowing thereby the drilling cuttings to be conveyed from the face side of the drill bit through the inner tube out of the drilling machine. In this solution size of the top and bottom working areas of the piston are both defined by inner diameters of the control sleeve at the working chambers and by an outer diameter of the inner tube.

An idea of an embodiment is that the drilling machine is a pneumatically operable device and the fluid is pressurized gas, such as pressurized air.

An idea of an embodiment is that the drilling machine is a hydraulic device. The device may be used by means of pressurized water, for example.

The above disclosed embodiments and their features may be combined.

BRIEF DESCRIPTION OF THE FIGURES

Some embodiments of the invention will be explained in greater detail in the attached drawings, in which.

In the figures, some embodiments of the invention are shown simplified for the sake of clarity. Like reference numerals refer to like parts in the figures.

DETAILED DESCRIPTION OF SOME EMBODIMENTS OF THE INVENTION

Figure 1:
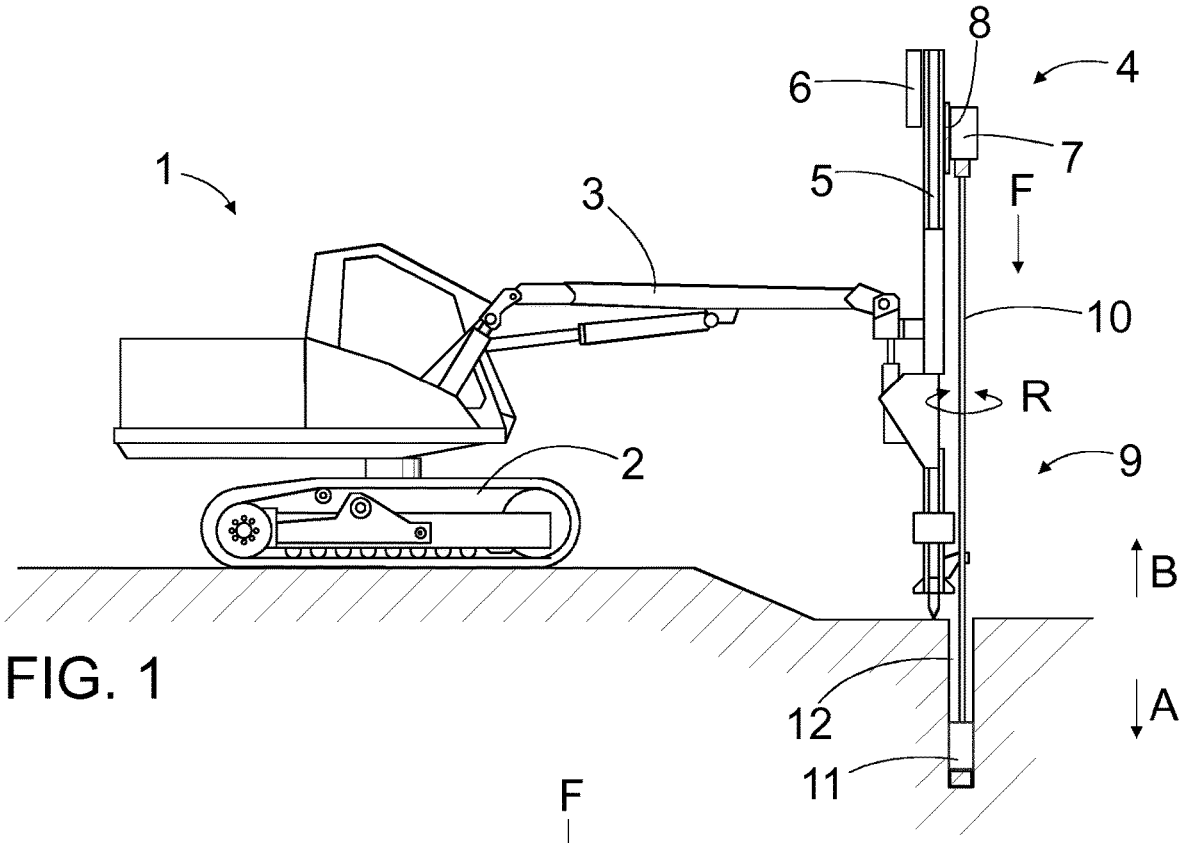
FIG. 1 shows schematically a rock drilling rig provided with a DTH rock drilling machine.

FIG. 1 shows a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and one or more rotating motors. The rotation unit 7 may be supported to a carriage 8 with which it is movably supported to the feed beam 5. The rotation unit 7 may be provided with drilling equipment 9 which may comprise one or more drilling tubes 10 connected to each other, and a DTH drilling machine 11 at an outermost end of the drilling equipment 9. The DTH drilling machine 11 is located in the drilled bore hole 12 during the drilling.

Figure 2:
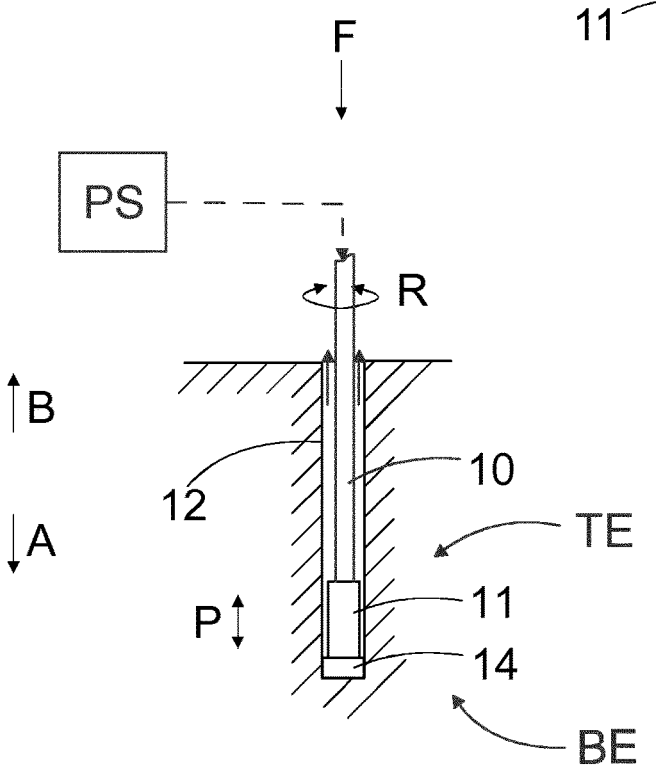
FIG. 2 shows schematically a DTH drilling machine at a bottom of a drill hole.

FIG. 2 shows that the DTH drilling machine 11 comprises an impact device 13. The impact device 13 is at the opposite end of the drilling equipment 9 in relation to the rotation unit 7. During drilling, a drill bit 14 is connected directly to the impact device 13, whereby percussions P generated by the impact device 13 are transmitted to the drill bit 14. The drilling equipment 9 is rotating around its longitudinal axis in direction R by means of the rotation unit 7 shown in FIG. 1 and, at the same, the rotation unit 7 and the drilling equipment 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling machine 11 through the drilling tubes 10. The pressurized fluid may be compressed air and the pressure source PS may be a compressor. The pressure fluid is directed to influence to working surfaces of a percussion piston of the drilling machine and to cause the piston to move in a reciprocating manner and to strike against impact surface of the drill bit. After being utilized in working cycle of the drilling machine 11 pressurized air is allowed to discharge form the drilling machine 11 and to thereby provide flushing for the drill bit 14. Further, the discharged air pushes drilled rock material out of the drill hole in an annular space between the drill hole and the drilling equipment 9. Alternatively, the drilling cuttings are removed from a drilling face inside a central inner tube passing through the impact device. This method is called reverse circulation drilling.

FIG. 2 indicates by an arrow TE an upper end or top end of the drilling machine 11 and by an arrow BE a lower end or bottom end of the drilling machine.

Figure 3A:
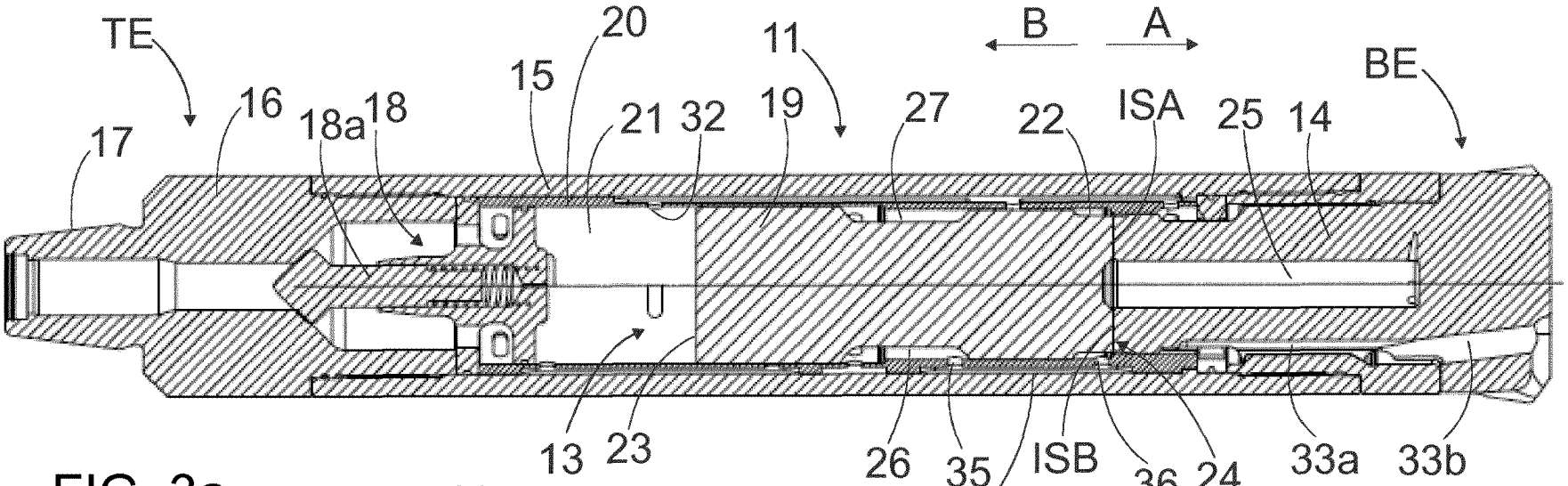
FIGS. 3*a* and 3*b* show schematically two different cross-sectional views of a DTH drilling machine.
Figure 3B:
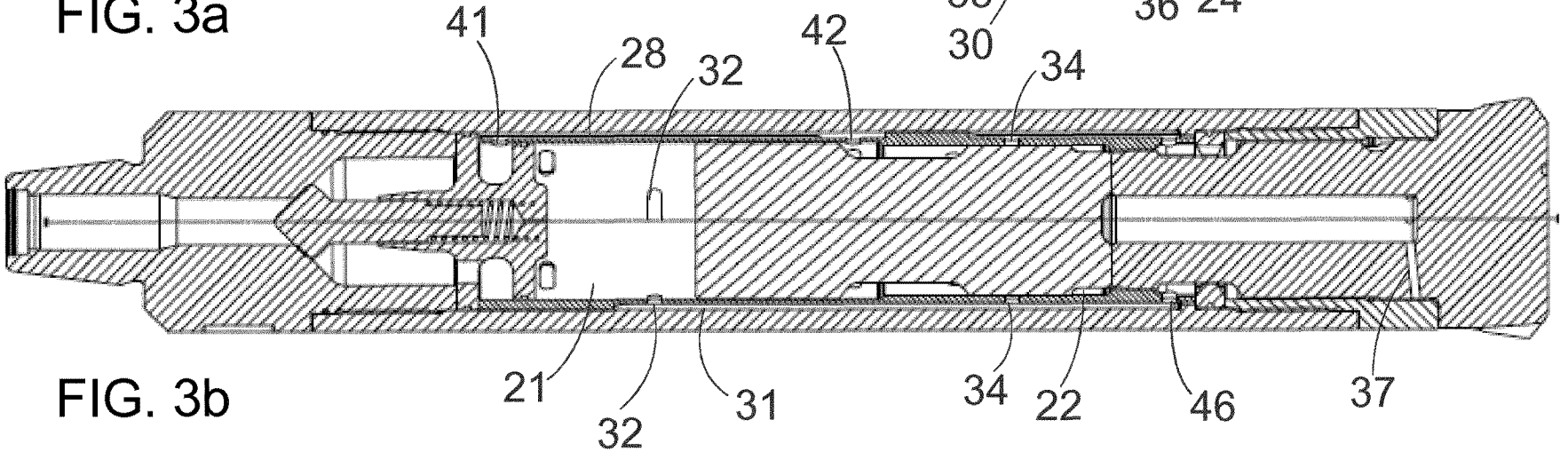

FIGS. 3*a* and 3*b* disclose a DTH drilling machine 11 and its impact device 13. The cross-sections are shown at differing points in FIGS. 3*a* and 3*b* in order to present openings and fluid passages arranged around the inner structure. The drilling machine 11 comprises an elongated casing 15, which may be a relatively simple sleeve-like frame piece. At a top end TE of the casing 15 is mounted a connection piece 16 by means of which the drilling machine 11 can be connected to a drill tube. The connection piece 16 may comprise threaded connecting surfaces 17. In connection with the connection piece 16 is an inlet port 18 for feeding pressurized fluid to the impact device 13. The inlet port 18 may comprise valve means 18*a*, which allow feeding of fluid towards the impact device but prevent flow in an opposite direction. The impact device 13 comprises a piston 19 which is arranged to be moved in a reciprocating manner during its work cycle. At a bottom end BE of the piston is an impact surface ISA arranged to strike an impact surface ISB at a top end of a drill bit 14. As can be noted, the piston 19 is a solid-core piece, whereby it is without any through channels or openings in axial and transverse directions. Between the casing 15 and the piston 19 is a control sleeve 20, which is not moved during the work cycle. At the top end TE side of the piston 19 is a top working chamber 21 and at the opposite end side is a bottom working chamber 22. Movement of the piston 19 is configured to open and close fluid passages for feeding and discharging the working chambers 21, 22 and to thereby cause the piston 19 to move towards an impact direction A and return direction B. In FIGS. 3*a*, 3*b* the piston 19 is at an impact point wherein the impact surface ISA has stroke the drill bit 14. Fluid routing is executed between inner surface of the casing 15 and an outer surface of the control sleeve 20. An outer periphery of the control sleeve 20 may comprise several grooves which serve as fluid passages. Transverse openings may connect the grooves to the working chambers, inlet port and discharge channels.

Since the piston 19 is inside the control sleeve 20, an inner diameter of the control sleeve defines maximum outer diameter of a top working surface 23 and a bottom working surface 24. The top working chamber 21 is inside the control sleeve 20, whereas the bottom working chamber 22 is partly defined by a central recess 25 of the drill bit 14.

Figure 10:
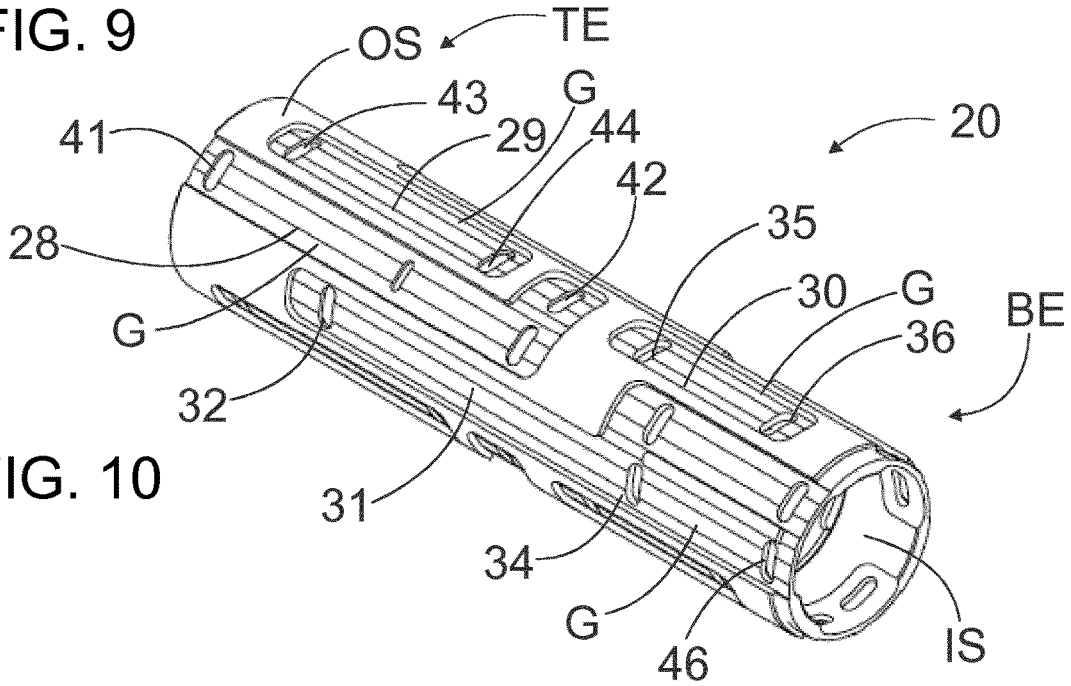
FIG. 10 shows schematically a control sleeve of a DTH drilling machine.

At a central portion of the piston 19 is thinned portion 26 with smaller diameter so that between the thinned portion and the control sleeve 20 is an annular central feed chamber 27. The feed chamber 27 is in constant fluid connection with the inlet port 18 through one or more main feed passages 28. The main feed passage 28 is connected to the inlet port 18 by means of a transverse opening 41 and is connected to the central feed chamber 27 by means of a transverse opening 42. The top working chamber 21 and the bottom working chamber 22 are fed by conveying fluid from the central feed chamber 27 through one or more top feed passages 29 and bottom feed passages 30. Further, the working chambers 21, 22 may be discharged by means of one or more discharge passages 31, which may be common for both working chambers 21, 22. The feed passages 28, 29, 30 and the shared discharge passage 31, together with their transverse openings, are best shown in FIG. 10 presenting the control sleeve 20.

In FIGS. 3*a*, 3*b* the piston 19 has opened transverse openings 32 to the shared discharge passages 31 whereby the top working chamber 21 is discharged through discharge channels 33*a*, 33*b* to the face of the drill bit 14. Transverse openings 34 between the shared discharge passages 31 and the bottom working chamber 22 are closed by the piston 19. FIG. 3*a* shows that the piston 19 has opened transverse openings 35 whereby fluid is fed from the central feed chamber 27 through the bottom feed passages 30 and transverse openings 36 to the bottom working chamber 22. When the top working chamber 21 is discharged and pressurized fluid is fed to the bottom working chamber 22, the piston 19 initiates movement towards the return direction B.

FIG. 3*b* further shows that at the bottom end of the recess 25 of the drill bit 14 may be a transverse discharge opening 37 allowing flushing of fluid to the side of the drill bit when the drill bit 14 is moved in the impact direction A relative to the casing 15 for executing flushing of the drilled bore hole.

Figure 4A:
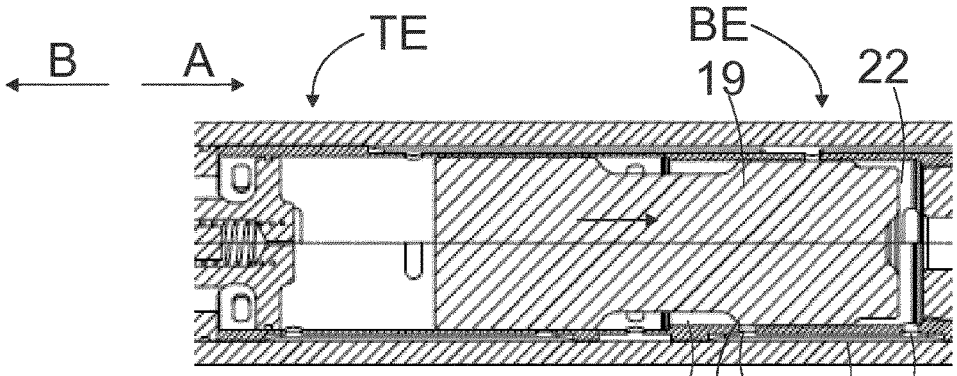
FIGS. 4*a* and 4*b* show schematically two different cross-sectional and partial views of the DTH drilling machine and illustrating timing of feed of the bottom working chamber.
Figure 4B:
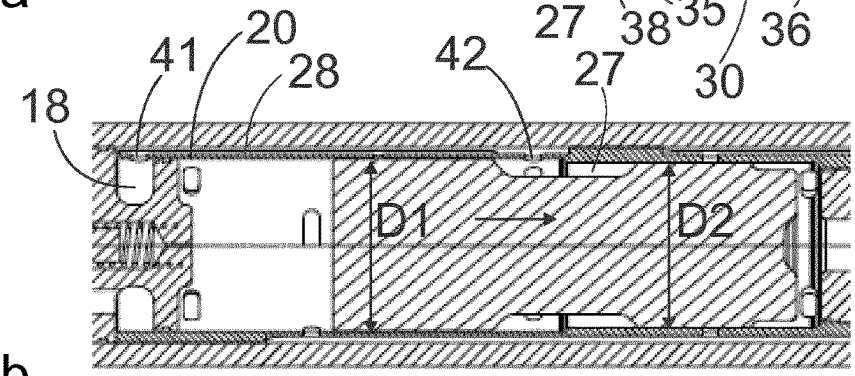

FIGS. 4*a* and 4*b* disclose situation when the piston 19 is moving in the impact direction A and an edge 38 of the piston 19 is about to open transverse opening 35 of the bottom feed passage 30. Then the bottom working chamber 22 is connected to the inlet port 18 via the main feed passage 28, the central feed chamber 27 and the bottom feed passage 30.

FIG. 4*b* further discloses that end portions of the piston 19 on opposite sides of the central feed chamber 27 have different diameters D1, D2 ensuring thereby that the piston 19 begins to move after stoppage when feed pressure effects in the central feed chamber on pressure surfaces having different areas.

Figure 5A:
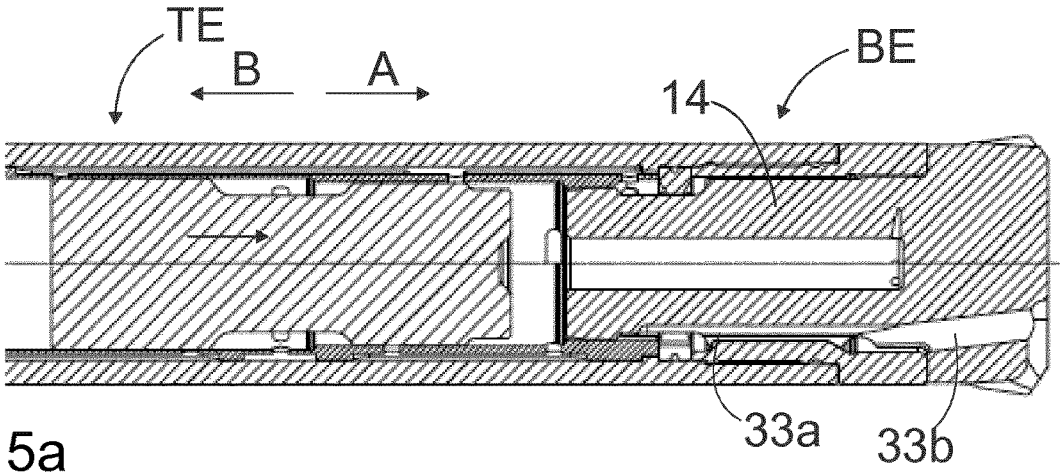
FIGS. 5*a* and 5*b* show schematically two different cross-sectional and partial views of the DTH drilling machine and illustrating timing of discharge of the top working chamber.
Figure 5B:
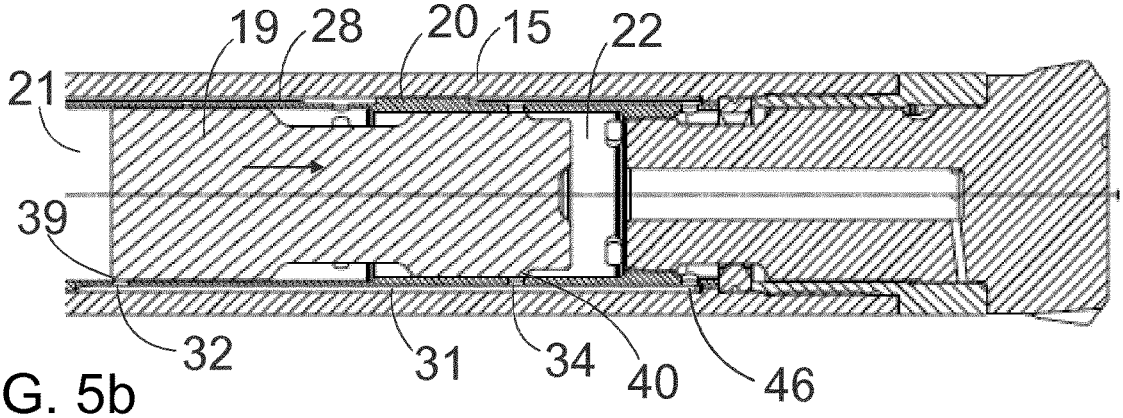

FIGS. 5*a* and 5*b* disclose that piston 19 is moving from top stroke position towards the impact direction A, and an edge 39 is about to open transverse opening 32 to the discharge passage 31 for discharging the top working chamber 21. An edge 40 of the piston 19 has already closed the transverse opening 34 between the bottom working chamber 22 and the discharge passage 31.

Figure 6A:
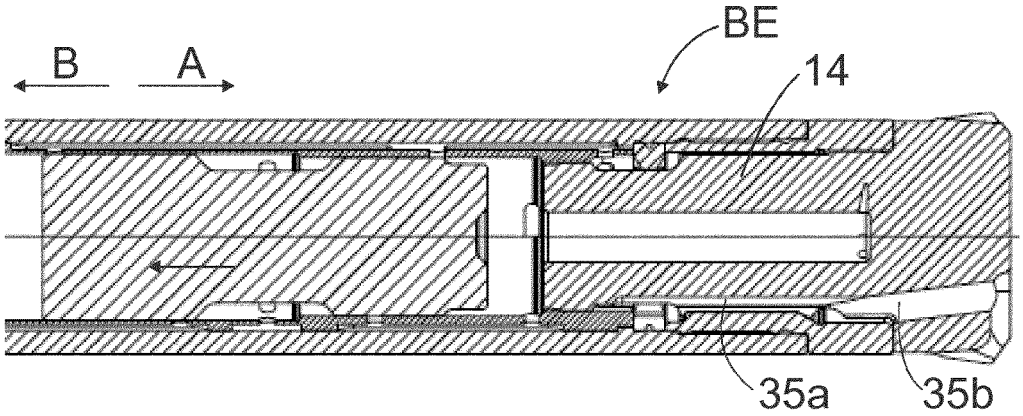
FIGS. 6*a* and 6*b* show schematically two different cross-sectional and partial views of the DTH drilling machine and illustrating timing of discharge of the bottom working chamber.
Figure 6B:
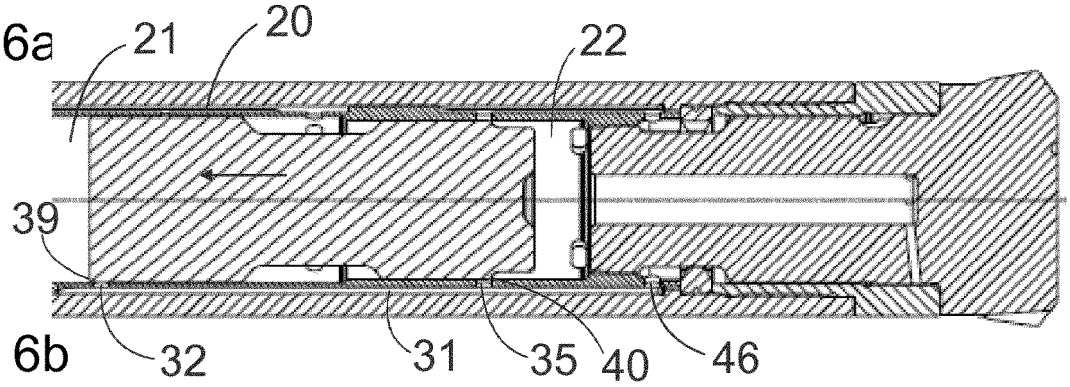

FIGS. 6*a* and 6*b* disclose that the piston 19 is moving towards the return direction B since pressure fluid is expanding in the closed bottom working chamber 22. When the piston 19 moves forward in the returns direction B the edge 40 of the piston opens the transverse opening 35 and connects the bottom working chamber 22 to the discharge passage 31. Further, the edge 39 has closed connection from the top working chamber 21 to the discharge passage 31 whereby the top working chamber 21 is prepared for fluid feeding.

Figure 7A:
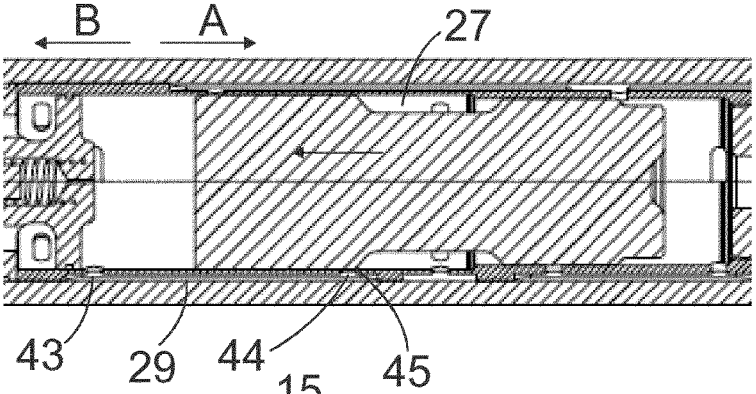
FIGS. 7*a* and 7*b* show schematically two different cross-sectional and partial views of the DTH drilling machine and illustrating timing of feed of the top working chamber.
Figure 7B:
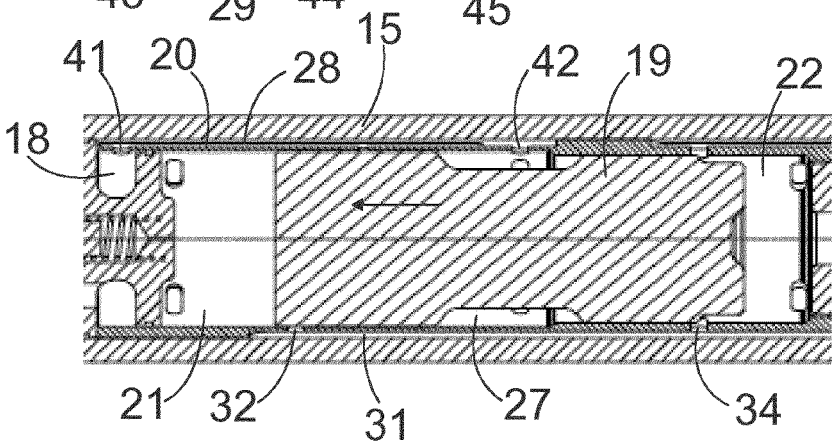

FIGS. 7*a* and 7*b* disclose that the transverse feed opening 44 will be opened by the edge 45 of the piston 19. Then fluid is conveyed through the top feed passage 29 and transverse opening 43 to the top working chamber 21. Discharge opening 34 between the bottom working chamber 22 and the discharge passage 31 has been opened.

Figure 8:
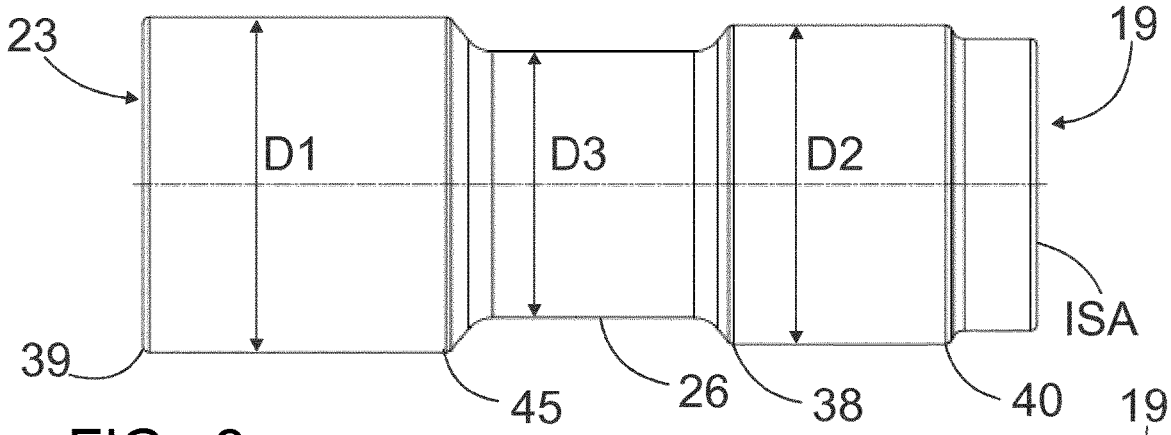
FIG. 8 shows schematically a side view of a solid-core piston of a DTH drilling machine.
Figure 9:
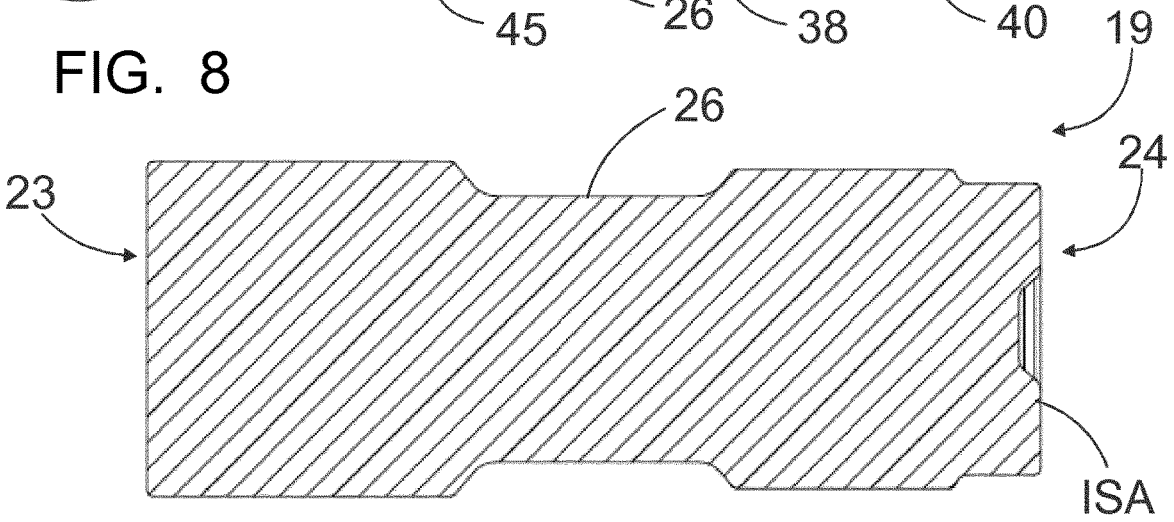
FIG. 9 is a cross-sectional view of the same.

FIGS. 8 and 9 disclose a piston 19, which may be a solid-core piece without any transverse or axial openings. As mentioned already above, the piston 19 comprises the central thinned portion 26 with smaller diameter D3 compared to diameters D1, D2 at the end portions. Since the reciprocating movement of the piston 19 is configured to control the work cycle of the impact device, the piston 19 is provided with edges 38, 39, 40 and 45, or control surfaces, for opening and closing the transversal openings of the fluid passages, as it is disclosed above.

FIG. 10 discloses a control sleeve 20 having an inner surface IS and an outer surface OS. The piston is supported and sealed against the inner surface IS and the outer surface OS is in contact with an inner surface of the casing. On the outer surface OS are several grooves G and transverse openings connecting the grooves G with the inner surface side of the control sleeve 20. The control sleeve 20 comprises one or more main feed passages 28 with openings 41 and 42, one or more top feed passages 29 with openings 43 and 44, one or more bottom feed passages 30 with openings 35 and 36, and further, one or more discharge passages 31 with openings 32, 34 and 46.

However, instead of the shared discharge passages, the working chambers may have discharge passages of their own.

Figure 11:
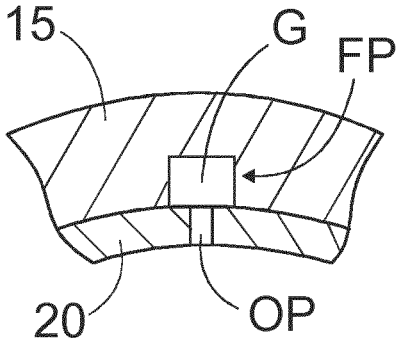
FIGS. 11 and 12 show schematically and in cross section principles of two alternative ways of forming fluid passages between a casing and a control sleeve.
Figure 12:
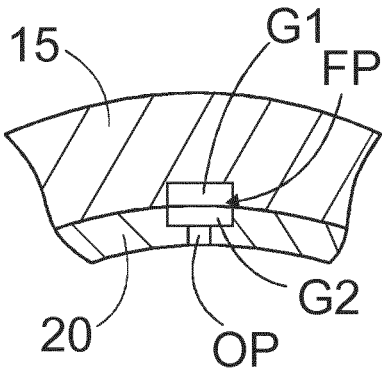

FIG. 11 discloses a solution wherein the casing 15 is provided with the grooves G and the control sleeve 20 has a smooth outer surface and is provided with openings OP at the grooves G. In FIG. 12 the casing 15 and the control sleeve 20 are both provided with groove halves G1, G2 which form together the needed fluid passage FP.

Figure 13:
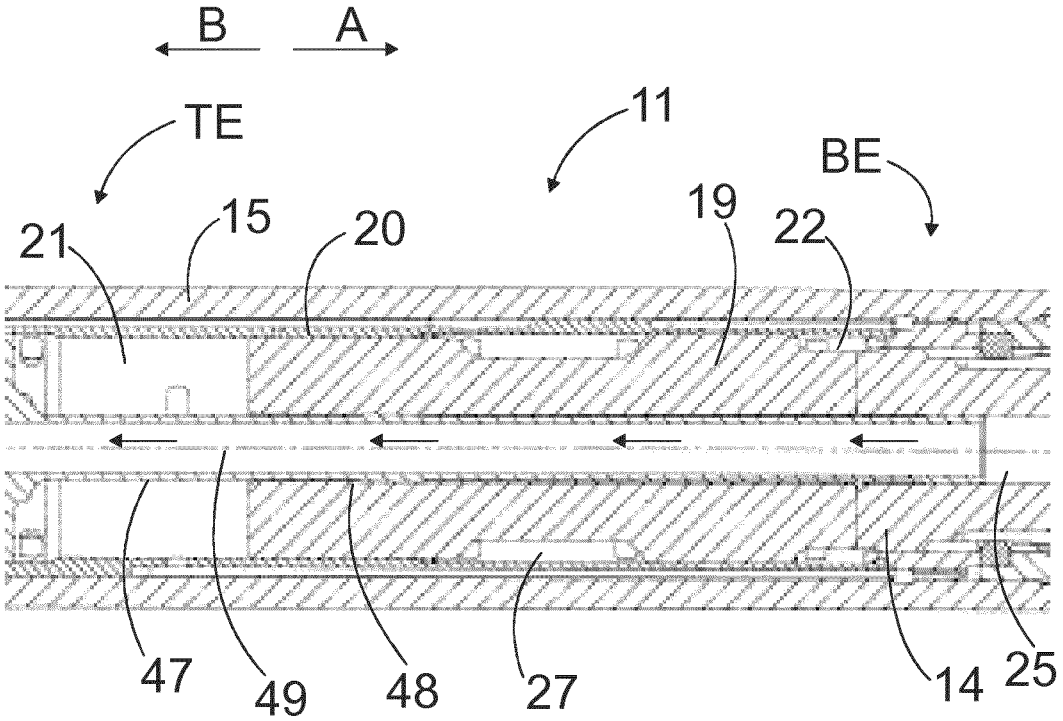
FIG. 13 shows schematically and in cross section part of DTH drilling machine applying principle of reverse circulation drilling, and FIGS. 14 and 15 disclose schematically and in cross section two alternative solutions to arrange separate sealing elements between the piston and the inner surface of the control sleeve.

FIG. 13 discloses part of a drilling machine 11, which differs from the above disclosed solutions in that the piston 19 is a sleeve-like piece through which an inner tube 47 passes. Thus, the piston 19 has a central opening 48. The inner tube 47 extends from the drill bit 14 to the top end TE of the drilling machine 11. Inside the inner tube 47 is a channel 49 for conveying drilling cuttings out of the drilled hole. The basic operational principle is substantially the same as described above. Also the fluid routing is executed between the control sleeve 20 and the casing 15.

Figure 14:
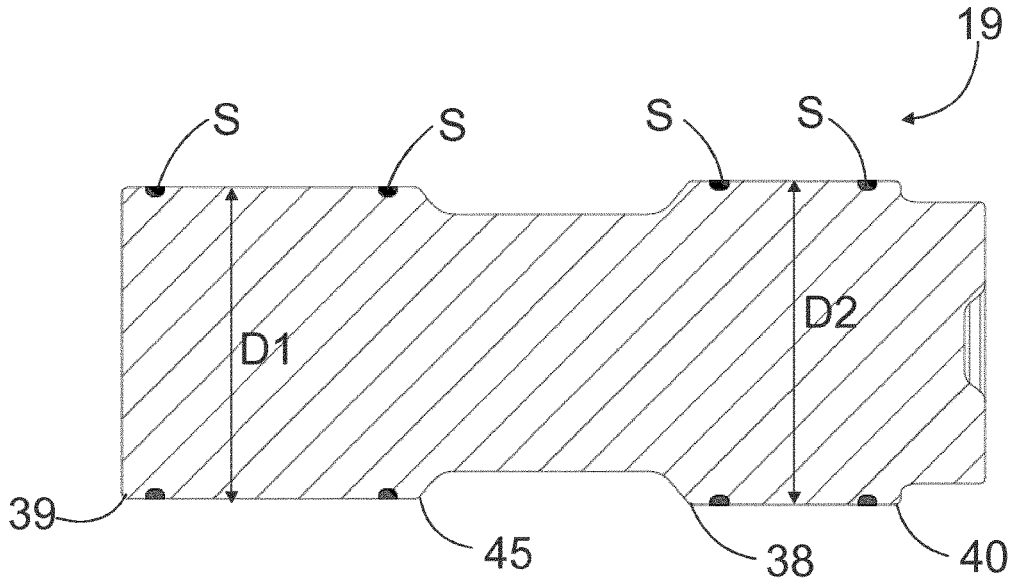
Figure 15:
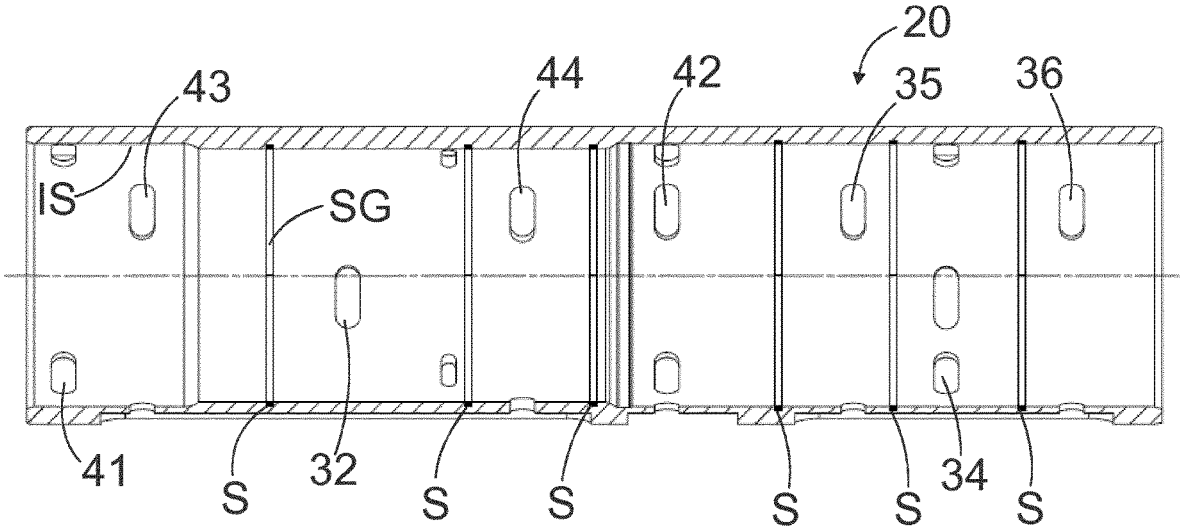

FIG. 14 discloses a piston 19 that corresponds to the piston 19 of FIG. 8 except that the piston of FIG. 14 is provided with seals S. Then, the end portions with the larger diameters D1 and D2 may both have two seals S arranged on seal grooves formed on their outer peripheries. The seals S may be located axially close to the controlling edges 38, 39, 40 and 45, which are arranged to open and close the fluid passages during the operation. By means of the seals S fluid leaks may be reduced and efficiency of the impact device may be increased. However, the seals S of the piston 19 may be substituted by arranging the seals S on the inner surfaces IS of the control sleeve 20, as it is shown in FIG. 15. Seal grooves SG may be formed on the inner surfaces IS in order to receive the seals. The seals S are located axially at selected positions between openings passing through the control sleeve. Otherwise the operation and structure of the control sleeve 20 may correspond to what has been disclosed above.

The drawings and the related description are only intended to illustrate the idea of the invention. Details of the invention may vary within the scope of the claims.

The invention claimed is:

1. A down the hole drilling machine comprising:

an elongated casing having a top end and a bottom end;

a fluid powered piston arranged movably inside the casing;

a top working chamber at a top side of the piston;

a bottom working chamber at a bottom side of the piston;

fluid passages and openings arranged for controlling feeding and discharging of pressurized fluid into and out of the top and bottom working chambers for generating reciprocating movement of the piston;

an inlet port at the top end for feeding the pressurized fluid;

a control sleeve inside the casing and including an inner surface and an outer surface and wherein the piston is arranged inside the control sleeve; and a drill bit arranged to be connected to the bottom end of the casing and provided with an impact surface facing towards the piston for receiving impacts of the piston, wherein the fluid passages include a plurality of fluid passages extending between the outer surface of the control sleeve and an inner surface of the casing surrounding the control sleeve, the plurality of fluid passages including one or more main feed passages, one or more top feed passages, one or more bottom feed passages and one or more discharge passages, wherein feed flows of the pressurized fluid to both the top and bottom working chambers and discharge flows of the pressurized fluid from both the top and bottom working chambers are conveyed between surfaces of the control sleeve and the casing.

2. The down the hole drilling machine as claimed in claim 1, wherein the plurality of fluid passages and openings are disposed in the outer surface of the control sleeve, wherein the plurality of fluid passages and openings comprise a plurality of axially directed fluid passages and at least one radial through opening at each of the axially directed fluid passages allowing fluid flow between the outer surface and the inner surface of the control sleeve.

3. The down the hole drilling machine as claimed in claim 1, wherein the fluid passages are grooves on the outer surface of the control sleeve, whereby the fluid passages are defined by the grooves and the inner surface of the casing.

4. The down the hole drilling machine as claimed in claim 1, wherein the fluid passages are grooves on the inner surface of the casing, whereby the fluid passages are defined by the grooves and the outer surface of the control sleeve.

5. The down the hole drilling machine as claimed in claim 1, wherein the piston has a solid-core configuration without any axial or transverse openings.

6. The down the hole drilling machine as claimed in claim 1, wherein the drill bit includes a central recess having a first open end towards the piston and a second closed end facing away from the piston, the recess of the drill bit being configured to constitute an additional fluid space and to be part of the bottom working chamber.

7. The down the hole drilling machine as claimed in claim 1, wherein, between the outer surface of the piston and an inner surface of the control sleeve, there is an annular central feed chamber, the annular feed chamber being in fluid connection with the inlet port, wherein constant pressure prevails inside the central feed chamber during a working cycle, and wherein the reciprocating movement of the piston is configured to open and close the connection between the central feed chamber and the top working chamber, and the bottom working chamber respectively, for connecting and disconnecting the top and bottom working chambers with the central feed chamber.

8. The down the hole drilling machine as claimed in claim 1, wherein the one or more discharge passages of the plurality of fluid passages includes at least one axial discharging passage including at least one shared discharging passage and the openings include at least one transverse opening, the top working chamber and the bottom working chamber sharing the at least one shared axial discharging passage located between the control sleeve and the inner surface of the casing, the shared axial discharging passage having at least one first transverse opening at the top working chamber and at least one second transverse opening at the bottom working chamber, and wherein the piston is configured to open and close alternately the first and second transverse openings during a working cycle of the piston.

9. The down the hole drilling machine as claimed in claim 1, wherein the drill bit has a central through passage, and wherein the piston has a central axial opening, an inner tube being located inside the central opening of the piston and the inner tube extending from the central passage of the drill bit to the top end of the drilling machine and being in fluid connection with a face of the drill bit allowing drilling cuttings to be conveyed from the face side of the drill bit through the drill bit and the inner tube out of the drilling machine, the piston having a top working area inside the top chamber and a bottom working area inside the bottom chamber, a size of the top and bottom working areas of the piston being both defined by an inner diameter of the control sleeve and an outer diameter of the inner tube.

10. The down the hole drilling machine as claimed in claim 1, wherein between an outer surface of the piston and an inner surface of the control sleeve are a plurality of seals.

11. The down the hole drilling machine as claimed in claim 1, wherein the drilling machine is a pneumatically operable device and the fluid is pressurized gas.

12. A method for drilling rock, comprising:

drilling rock with a down the hole rock drilling machine having at least a casing, a piston disposed inside the casing and a drill bit located at a bottom end of the casing;

moving the piston in a reciprocating manner inside the casing in an impact direction and a return direction by feeding and discharging pressurized fluid to a top working chamber and to a bottom working chamber, which are located on opposite sides of the piston;

controlling the feeding and discharging of the fluid by means of the movements of the piston; and striking an impact surface of the drill bit by the piston;

moving the piston inside a control sleeve arranged inside the casing; and feeding pressurized fluid to both the top and bottom working chambers and discharging the fluid from both the top and bottom working chambers through one or more main feed passages, one or more top feed passages, one or more bottom feed passages and one or more discharge passages disposed between an outer surface of the control sleeve and an inner surface of the casing being in physical contact with the control sleeve.

* * * * *